United States Patent [19]

Tzeng

[11] 4,067,580

[45] Jan. 10, 1978

[54] MYSTIC NUMBERED GEOMETRICS

[76] Inventor: John Jenn Tzeng, 416 Boston Ave., Takoma Park, Md. 20012

[21] Appl. No.: 690,179

[22] Filed: May 26, 1976

[51] Int. Cl.[2] ..... A63F 9/08

[52] U.S. Cl. ..... 273/156; 35/31 G; 273/161; 273/294 GA

[58] Field of Search ..... 273/156, 157 R, 155, 273/161, 137 D; 35/31 G, 70

[56] References Cited

U.S. PATENT DOCUMENTS

| | | | |
|---|---|---|---|
| 284,037 | 8/1883 | McCleary | 273/156 |
| 487,797 | 12/1892 | Thurston | 273/156 |
| 728,249 | 5/1903 | Lamme | 273/156 |
| 1,558,165 | 10/1925 | Haswell | 273/156 X |
| 3,655,201 | 4/1972 | Nichols | 273/155 UX |

*Primary Examiner*—Anton O. Oechsle

[57] ABSTRACT

An educational and entertaining device comprising a set of geometrically identical or proportional elements, each of which includes a plurality of coded indicia bearing surface portions with at least one numeral on each surface portion, the number of elements in said set and the number of said surface portions being identical and at least four in number, said numerals being so related to said coding indicia that if the elements are arrayed such that a differently coded surface portion of each of the elements is disposed for viewing, regardless of which coded surface portion of which element is so disposed, the sum of the numerals on the so disposed surface portions is a constant.

10 Claims, 12 Drawing Figures

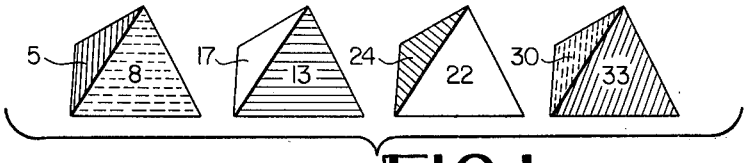
FIG. 1
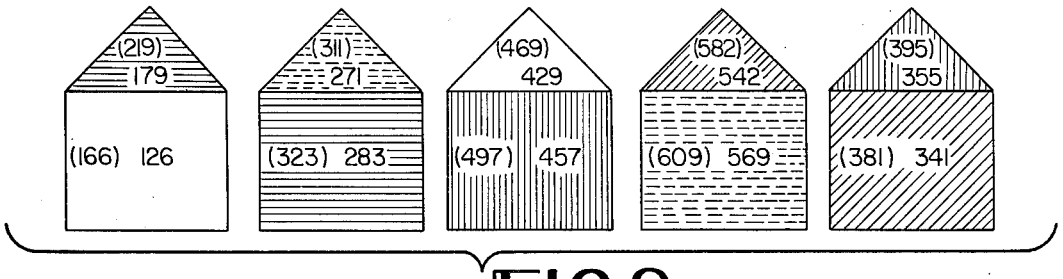
FIG. 2
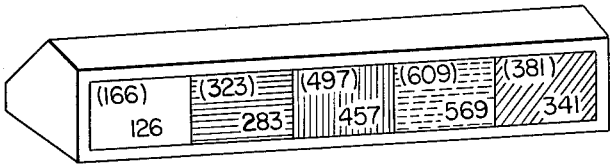
FIG. 3
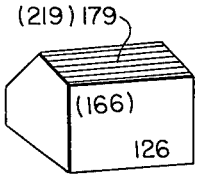
FIG. 4
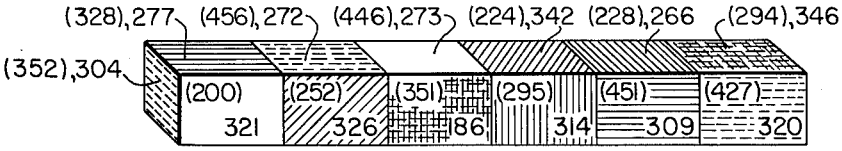
FIG. 5
FIG. 6
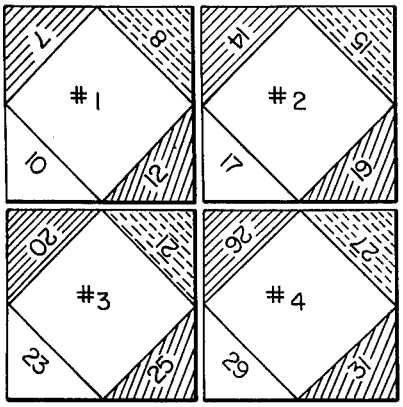
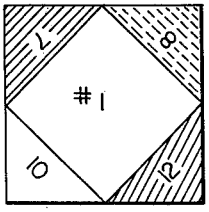
FIG. 7
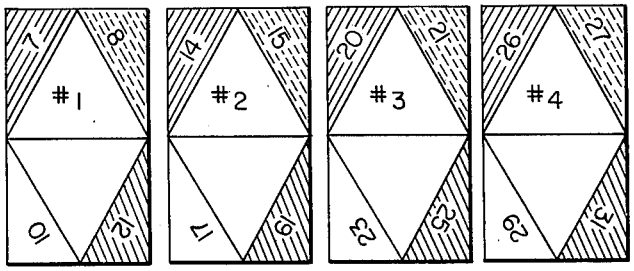
FIG. 8

MYSTIC NUMBERED GEOMETRICS

In a preferred aspect, the numbers on each selected color-coded part of the forms will add up to get the spirit of 76 — in hundreds or even half a million different ways of doing this. The principal object of this puzzle which exercises the mental facilities in addition and subtraction is to provide a fascinating source of pleasure, curiosity, attention, and amusement based on laws of permutations and combinations. A further object is to provide educational opportunities for increasing one's effectiveness in mathematical operations when the interesting numbers on the chosen parts of the geometric forms are to be added or subtracted accurately by him.

With the foregoing objects in view, my invention contemplates, in the preferred embodiment of Bicentennial Polyhedra and Polygons, a provision of novel series of numbers of coded parts thereof; and the sum of the numbers on the selected different parts of a set of the geometric forms will always add up to 76, 1776, or 1976.

BRIEF DESCRIPTION OF THE DRAWINGS

FIG. 1 is a set of four regular triangular pyramids, each of which has four color or pattern coded faces as surface portions;

FIG. 2 is a set of five triangular prisms with the five faces of each of these prisms as the surface portions;

FIG. 3 shows a set of five identical pentagonal prisms, each of which has five rectangular faces distinguishable by color or pattern as the surface portions, and the entire set of these prisms are put in a container in the form of an elongated pentagonal prism having a window extending along one rectangular face thereof through which a single face of each of the prisms is displayed;

FIG. 4 is one element of the set as shown in FIG. 3.

FIG. 5 shows a set of elements constituted by six cubes, and the six faces of the respective cubes are the surface portions;

FIG. 6 is a set of elements constituted by four square cards, and the surface portions thereof are constituted by areas adjacent each edge of each card such that the cards can be arrayed either with the areas intended to be viewed contiguous to each other or in a stack with the areas to be viewed superimposed;

FIG. 7 shows a single element of the set as shown in the FIG. 6;

FIG. 8 is a set of four elements constituted by four rectangular cards similar to the square cards as shown in the FIG. 6;

Figure 9:
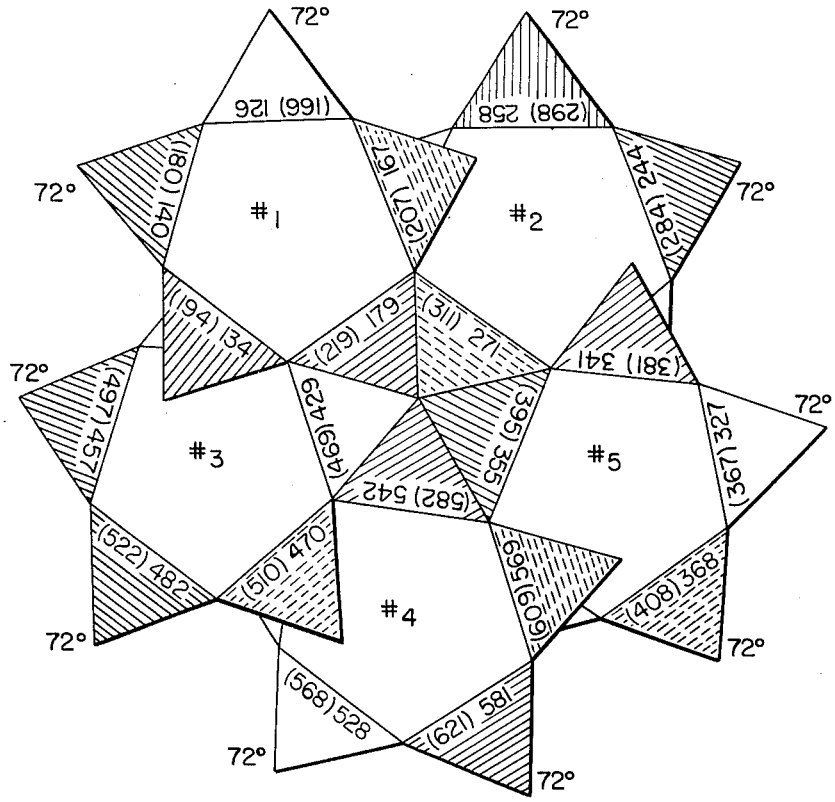
FIG. 9 is a set of elements constituted by five five-pointed star-shaped polygons and their surface portions are constituted by the points thereof.

The nature and characteristic features of my invention will be more readily understood from the following descriptions, taking in connection with the accompanying drawings forming part thereof, in which:

FIG. 1 is a set of regular triangular pyramids (tetrahedra). Each consists of 4 different colored faces, namely red, blue, white, and white-on-blue (starred), with a mystic number on each face. If one places this set of pyramids in such a way that the color of each base (the bottom face) is different from the other; that is, the bases are selected with one in red, one in blue, one in white, and one in white-on-blue, then the total of the numbers on these bases is 76, the spirit of the Bicentennial of the United States. Although there are $4^2 \times 3^2 \times 2^2 \times 1$ or 576 different ways of doing this, in any of these ways the total is always 76.

The mystic numbers can be found in a number of different ways. Here the diagonal approach is used for finding a number of different sets of the numbers, ranging from 4 to 34 without repetition. The set used for FIG. 1, according to the order of red, blue, white, and white-on-blue faces thereon, for the first pyramid includes 5, 8, 9, 11; for the second pyramid 13, 16, 17, 19; for the third pyramid 18, 21, 22, 24; and for the fourth 27, 30, 31, and 33. Following the same order, another set of the numbers can be: 4, 6, 9, 10 for the first pyramid, 13, 15, 18, 19 for the second pyramid, 18, 20, 23, 24 for the third pyramid, and 28, 30, 33, 34 for the fourth pyramid. Besides, many other sets of such numbers can be found as well. In FIG. 1, if all the front faces of the pyramids are turned to be bases, the number 8 on the blue face of the first pyramid, 13 on the red face of the second pyrramid, 22 on the white face of the third pyramid, and 33 on the white-on-blue face of the fourth pyramid will add up to 76, as all these colors are not the same.

If all the selected faces (or bases) are different in color, by adding any three numbers thereon to get a subtotal, the fourth number can be found without even looking at it because one can subtract the subtotal from 76 and get it mentally and quickly. For this reason, the device can also be used for "mindreading".

Further, by using a scanning device in a computer system, the adding method for this constant, the predetermined sum, is even more interesting (just like some supermarkets' billing system.)

FIG. 2 is a set of Bicentennial Prisms. This set has 5 triangular prisms (pentahedra). Each has 5 different colored faces; namely red, blue, white, white-on-blue (starred), and white-on-red (striped). Like the Bicentennial Pyramids described above, mystic numbers are also found in each prism. But instead of one, there are two numbers on each face, one with a parenthesis and the other without this special mark. If one arranges these 5 prisms together with different colored bases (the bottom face), then the total of numbers with parenthesis on these bases is always 1976, the year we celebrate the American Bicentennial, while the total of numbers without parenthesis is exactly 1776, the year the United States was founded. Following the same method used for figuring the ways in adding numbers for the Bicentennial Pyramids, one can find out $5^2 \times 4^2 \times 3^2 \times 2^2 \times 1$ or 14,400 different ways to do so for the prisms. The following table shows the numbers on each face of the 5 prisms. Note that the numbers without the parenthesis on each face is just 40 less than that with the parenthesis on the same face.

| | | Red | Blue | White | White-on -Blue | White-on-Red |
|---|---|---|---|---|---|---|
| Prism A: | Number for 1976 | (219) | (207) | (166) | (180) | (194) |
| | Number for 1776 | 179 | 167 | 126 | 140 | 154 |
| Prism B: | Number for 1976 | (323) | (311) | (270) | (284) | (298) |
| | Number for 1776 | 283 | 271 | 230 | 244 | 258 |
| Prism C: | Number for 1976 | (522) | (510) | (469) | (483) | (497) |
| | Number for 1776 | 482 | 470 | 429 | 443 | 457 |
| Prism D: | Number for 1976 | (621) | (609) | (568) | (582) | (596) |
| | Number for 1776 | 581 | 569 | 528 | 542 | 556 |
| Prism E: | Number for 1976 | (420) | (408) | (367) | (381) | (395) |
| | Number for 1776 | 380 | 368 | 327 | 341 | 355 |

Due to the fact that not all the 5 numbered faces are congruent shapes in a triangular prism, another format to deal with this shortcoming is to take advantage of cubes. To use the cube, instead of the prism, is much more convenient, but there is an extra face on it. However, this extra face can be left blank or can be used for printing instructions. If cubes are used, the arrangement can be made similar to FIG. 5, except that there are $6^2 \times 5^2 \times 4^2 \times 3^2 \times 2^2 \times 1$ or over half a million different ways of doing this for FIG. 5 cubes — but only 14,400 different was for using 5 faces of the cubes.

Still another format which is even better than the cubes is to make 5 identical pentagonal prisms to be put in a long pentagonal container (FIG. 3) with a window to show the selected faces and the numbers thereon, so that numbers on the selected different faces can be seen and added up to 1976 and 1776 like the 5 triangular prisms in FIG. 2.

When the numbers are marked properly on the coded faces of the prisms, the total of numbers of any side may be added up to 1976 and 1776 if the color on one single side is not repetitive in the arrangement of prisms with respect to one another.

To adapt these 5 prisms in a rotatable cylinder with a long window on one side similar to the FIG. 3 may seem good too.

FIG. 5 is still another format of Bicentennial Polyhedra. They are six cubes with mystic numbers on each side. Like the Bicentennial Prisms described above, these Bicentennial Cubes have color-coded faces. In addition to the five colors for the prisms, the sixth color, blue-on-red is used for the 6th face. If the six cubes are so assembled in a row that no duplication in color arises on one side, then the numbers thereon will add up to 1976 and 1776 like those prisms. The following table shows the numbers on each side of the Cubes:

| | | Red | Blue | White | White-on-Blue | White-on-Red | Blue-on-Red |
|---|---|---|---|---|---|---|---|
| Cube A: | No. for 1976 | (328) | (352) | (200) | (148) | (105) | (219) |
| | No. for 1776 | 277 | 304 | 321 | 358 | 234 | 330 |
| Cube B: | No. for 1976 | (432) | (456) | (304) | (252) | (209) | (323) |
| | No. for 1776 | 245 | 272 | 289 | 326 | 202 | 298 |
| Cube C: | No. for 1976 | (574) | (598) | (446) | (394) | (351) | (465) |
| | No. for 1776 | 229 | 256 | 273 | 310 | 186 | 282 |
| Cube D: | No. for 1976 | (404) | (428) | (276) | (224) | (181) | (295) |
| | No. for 1776 | 261 | 288 | 305 | 342 | 218 | 314 |
| Cube E: | No. for 1976 | (451) | (475) | (323) | (271) | (228) | (342) |
| | No. for 1976 | 309 | 336 | 313 | 390 | 266 | 362 |
| Cube F: | No. for 1976 | (403) | (427) | (275) | (223) | (180) | (294) |
| | No. for 1776 | 293 | 320 | 337 | 374 | 250 | 346 |

Figure 10:
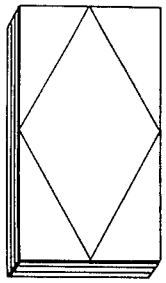
FIG. 10 shows a set of elements of four rectangular cards arrayed in a stack with the areas to be viewed superimposed.
Figure 11:
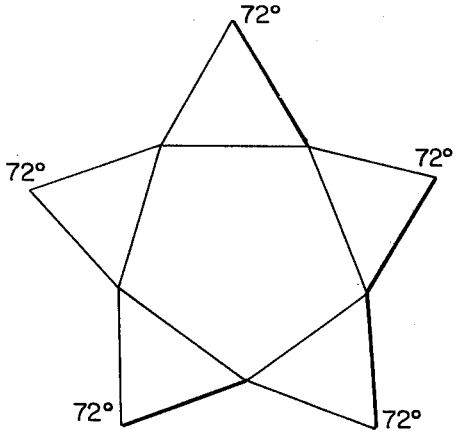
FIG. 11 is a single element of the set as shown in the FIG. 9.
Figure 12:
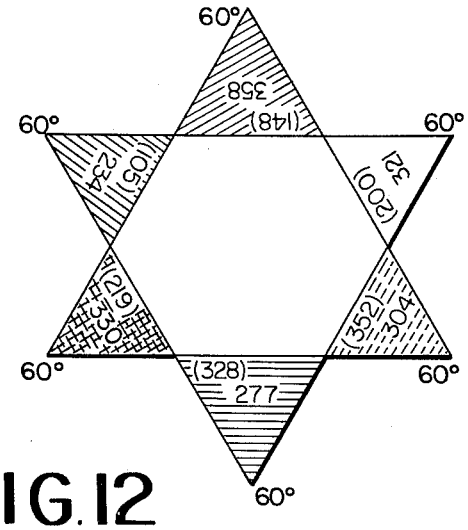
FIG. 12 shows one of six elements of a set of six six-pointed star-shaped polygons similar to the five five-pointed star-shaped polygons as shown in the FIG. 9 and the FIG. 11.

To simplify the devices mentioned above, the mystic numbers marked on those polyhedra can be transferred to polygons as shown in the FIGS. 6–12. FIG. 7 shows the square taking place of a tetrahedron. The four corners of the square are equivalent to the four faces of a tetrahedron, with numbers thereon and color-coded too. When one arranges the set of cards (square) in such a manner that the color of each corner is different from the other, FIG. 6 (they meet in the center) then the total of the numbers on these corners is 76. If it is in rectangular format, FIG. 8, the cards with respect to one another can be arranged in a stack, FIG. 10, and the numbers on different colored corners can still add up to 76. Of course, square cards, FIG. 7, can arrange in a stack and get the same total too.

To simplify the Bicentennial Prisms, 5 star shape polygons (FIG. 9), with a 72° angle in each direction, can do the same trick. If the five stars with respect to one another are so arranged that each of the 72° angles is different from the other in color and are meeting at the same point with parts of the stars overlapping (FIG. 9) or overlapping entirely (FIG. 11), then the numbers on these different colored corners will add up to 1976 and 1776 just as those done by the Bicentennial Prisms. By the same token, if they are six six-cornered stars, like the one shown in FIG. 12, the same results can be expected.

A search has revealed the following patents:

F. W. Brandt U.S. Pat. No. 1565901 12/15/1925

T. P. Palazzolo U.S. Pat. No. 3746345 7/17/1973

F. A. Schossow U.S. Pat. No. 646463 4/3/1900

B. G. Lamme U.S. Pat. No. 728249 5/19/1903 and a set of playing pieces of educational apparatus (3869124) as well as the pattern forming puzzle and method with pieces rotatable in groups (3655201), but none of them has mystic numbered geometrics like mine.

What is claimed is:

1. A device of the type described comprising a set of geometrically identical elements, each element including a plurality of indicia bearing surface portions, the number of elements in said set and the number of said surface portions being identical and at least four in number, the indicia on each said surface portion being in the form of a coding indicium and at least one numeral, said coding indicium being taken from a set of coding indicia equal in number to said number of elements and surface portions with each surface portion of each element bearing a different coding indicium, said numerals being so related to said coding indicia that if the elements are arrayed such that a differently coded surface portion of each of the elements is disposed for viewing, regardless of which coded surface portion of which element is so disposed, the sum of the numerals on the so disposed surface portions is a constant.

2. A device as recited in claim 1 wherein said coding indicia are colors.

3. A device as recited in claim 1 wherein said constant is 76, 1776 or 1976.

4. A device as recited in claim 1 wherein said elements are constituted by a set of four regular triangular pyramids and said surface portions are the four faces of the respective pyramids.

5. A device as recited in claim 1 wherein said elements are constituted by a set of five triangular prisms and said surface portions are the five faces of the respective prisms.

6. A device as recited in claim 1 wherein said elements are constituted by a set of five pentagonal prisms and said surface portions are the five rectangular faces of the respective prisms.

7. A device as recited in claim 6 which further includes a container in the form of an elongated pentagonal prism having a window extending along one rectangular face thereof, said container being sized to accept said prisms and display a single face of each of the prisms through said window.

8. A device as recited in claim 1 where in said elements are constituted by a set of six cubes and said surface portions are the six faces of the respective cubes.

9. A device as recited in claim 1 wherein said elements are constituted by a set of four rectangular or square cards and said surface portions are constituted by areas adjacent each edge of each card such that the cards can be arrayed either with the areas intended to be viewed contiguous to each other or in a stack with the areas to be viewed superimposed.

10. A device as recited in claim 1 wherein said elements are constituted by a set of star-shaped polygons and said surface portions are constituted by the points thereof, said set including either five five-pointed star-shaped polygons or six six-pointed star-shaped polygons.

* * * * *